US009809439B2

(12) United States Patent
Falco, III

(10) Patent No.: US 9,809,439 B2
(45) Date of Patent: Nov. 7, 2017

(54) SANITARY TOUCH-FREE AUTOMATIC CONDIMENT DISPENSING APPARATUS AND METHOD OF USE

(71) Applicant: Ernest F. Falco, III, Longwood, FL (US)

(72) Inventor: Ernest F. Falco, III, Longwood, FL (US)

( * ) Notice: Subject to any disclaimer, the term of this patent is extended or adjusted under 35 U.S.C. 154(b) by 0 days.

(21) Appl. No.: 14/480,166

(22) Filed: Sep. 8, 2014

(65) Prior Publication Data

US 2016/0068383 A1 Mar. 10, 2016

(51) Int. Cl.

| | |
|---|---|
| ***B67D 1/08*** | (2006.01) |
| *A47K 5/12* | (2006.01) |
| *B67D 7/34* | (2010.01) |
| *B67D 7/32* | (2010.01) |
| *E03C 1/05* | (2006.01) |
| *B67D 7/02* | (2010.01) |
| *B67D 7/08* | (2010.01) |
| *B67D 7/72* | (2010.01) |
| *B67D 7/30* | (2010.01) |

(52) U.S. Cl.

CPC ..... *B67D 1/0888* (2013.01); *A47K 5/1217* (2013.01); *B67D 7/0238* (2013.01); *B67D 7/08* (2013.01); *B67D 7/302* (2013.01); *B67D 7/3263* (2013.01); *B67D 7/346* (2013.01); *B67D 7/72* (2013.01); *B67D 2210/0016* (2013.01); *E03C 1/057* (2013.01)

(58) Field of Classification Search

CPC ..... A47K 5/1217; A47K 5/12; A47K 5/1202; G07F 11/002; B67D 7/06; B67D 7/02; B67D 7/08; B67D 7/221; B67D 7/30; B67D 7/302; B67D 7/3263; B67D 7/0238; B67D 7/72; B67D 7/346; B67D 7/58; B67D 1/0888; E03C 1/05; E03C 1/055; E03C 1/057; B65B 3/00; G08B 1/08; G08B 23/00

USPC ..... 700/231, 241; 222/1, 52, 61, 63, 132, 222/135, 181.1, 185.1, 330–331, 399, 222/504, 639, 641, 37; 141/94–95

See application file for complete search history.

(56) References Cited

U.S. PATENT DOCUMENTS

| | | | | |
|---|---|---|---|---|
| 2,264,631 | A | 12/1941 | Fetty | |
| 3,432,217 | A | 3/1969 | Cowan | |
| 4,108,513 | A | 8/1978 | Lander | |
| 4,372,354 | A * | 2/1983 | Moore | B67D 7/72 141/361 |
| 4,771,966 | A | 9/1988 | Anderson | |
| 4,790,490 | A | 12/1988 | Chakravorty | |
| 4,796,825 | A | 1/1989 | Hawkins | |
| 4,826,262 | A | 5/1989 | Hartman et al. | |
| 4,942,992 | A | 7/1990 | Fischer et al. | |

(Continued)

*Primary Examiner* — Paul R Durand
*Assistant Examiner* — Andrew P Bainbridge
(74) *Attorney, Agent, or Firm* — Lesavich High-Tech Law Group, S.C.; Sephen Lesavich

(57) ABSTRACT

A sanitary touch-free automatic condiment dispensing apparatus and method of use. The automatic sanitary touch-free condiment dispensing apparatus includes a two-stage detection process for detecting and automatically dispensing a pre-determined amount of a condiment/sauce (e.g., ketchup, mustard, mayo, food sauces, desert sauces, syrups, salad dressing, etc.) or another fluid (e.g., soap, shampoo, etc.). without accidental or wasteful dispensing.

21 Claims, 8 Drawing Sheets

(56) References Cited

U.S. PATENT DOCUMENTS 4,960,248 A 10/1990 Bauer et al.
4,979,688 A 12/1990 Tinker
5,088,620 A 2/1992 Kelliher et al.
5,097,950 A 3/1992 Weiss et al.
5,125,623 A 6/1992 Kiedinger
5,199,118 A 4/1993 Cole et al.
5,199,119 A 4/1993 Weber
5,329,672 A 7/1994 Froehlich et al.
5,344,047 A 9/1994 Chen
5,361,812 A 11/1994 Arneson et al.
5,398,931 A 3/1995 Tahgoh
5,409,181 A 4/1995 Patrick
5,417,261 A 5/1995 Kanzler et al.
5,511,763 A 4/1996 Green
5,492,247 A 11/1996 Shu et al.
5,625,908 A * 5/1997 Shaw ..... E03C 1/057 4/623
5,772,291 A 6/1998 Byrd et al.
5,878,909 A 3/1999 Rogow
5,884,784 A 3/1999 Betts, Sr.
5,927,543 A 7/1999 Dejardin et al.
5,988,440 A 11/1999 Saunders et al.
6,021,920 A 2/2000 Aldape
6,082,587 A * 7/2000 Martindale ..... B67C 3/2608 222/108
6,098,917 A 8/2000 Cruz
6,189,736 B1 * 2/2001 Phallen ..... F04B 13/02 222/105
6,227,420 B1 * 5/2001 Jepson ..... B65B 39/00 222/1
6,543,642 B1 4/2003 Milliorn
6,607,160 B2 8/2003 Lewis et al.
6,708,841 B2 3/2004 Baughman
6,749,148 B2 6/2004 Helfer-Grand
6,820,753 B2 11/2004 Kurtz et al.
6,894,270 B2 * 5/2005 Bailey ..... G01V 8/12 250/221
6,901,723 B2 6/2005 Jordan et al.
6,903,654 B2 6/2005 Hansen et al.
6,953,130 B2 10/2005 Corbett
6,977,588 B2 12/2005 Schotz
7,063,233 B2 6/2006 Jordan et al.
7,258,247 B2 * 8/2007 Marquez ..... G07F 11/06 221/124
7,296,765 B2 11/2007 Rodrian
7,588,168 B2 9/2009 Bagwell et al.
7,617,850 B1 * 11/2009 Dorney ..... B67D 1/0888 141/104
7,635,067 B1 12/2009 Flynn
7,841,556 B2 11/2010 Elliott et al.
7,963,475 B2 6/2011 Rodrian
7,987,756 B2 8/2011 Lewis et al.
8,096,445 B2 1/2012 Yang et al.
8,132,692 B2 3/2012 Jordan
8,146,781 B2 4/2012 Robertson et al.
8,196,775 B1 6/2012 Ballesteros
8,237,558 B2 * 8/2012 Seyed Momen ..... G01S 1/70 222/23
8,419,024 B1 4/2013 Arroyo-Ferrer
8,463,765 B2 6/2013 Lesavich
8,650,736 B2 2/2014 Robertson et al.
8,700,809 B2 * 4/2014 Ferragut, II ..... F24C 7/082 251/149
8,960,493 B1 2/2015 Dennison et al.
8,960,514 B2 2/2015 Lee
9,037,564 B2 5/2015 Lesavich et al.
9,078,647 B2 7/2015 Dennison et al.
9,137,250 B2 9/2015 Lesavich et al.
9,569,771 B2 2/2017 Lesavich et al.
2002/0040912 A1 4/2002 McHugh
2002/0113079 A1 8/2002 Corbett
2003/0057222 A1 3/2003 Million
2003/0116580 A1 6/2003 Baughman
2003/0222779 A1 12/2003 Schotz et al.
2003/0230591 A1 12/2003 Jordan et al.
2004/0050876 A1 3/2004 Muderlak
2004/0099623 A1 5/2004 Kurtz
2004/0134924 A1 7/2004 Hansen et al.
2004/0172918 A1 9/2004 Jordan et al.
2004/0226962 A1 * 11/2004 Mazursky ..... A47K 5/1217 222/95
2005/0087255 A1 * 4/2005 Humphrey ..... A47G 19/2227 141/94
2006/0144847 A1 7/2006 Jordan et al.
2006/0175341 A1 8/2006 Rodrian
2007/0000941 A1 1/2007 Hadden
2007/0010389 A1 1/2007 Cutrona
2007/0012714 A1 1/2007 Bagwell et al.
2007/0158359 A1 7/2007 Rodrian
2007/0213877 A1 9/2007 Hart et al.
2007/0215628 A1 9/2007 Tramontina
2007/0222554 A1 9/2007 Hart
2008/0116314 A1 5/2008 Elliott
2008/0185399 A1 8/2008 Yang
2009/0108122 A1 4/2009 Sahud
2009/0140001 A1 6/2009 Lewis
2009/0183796 A1 * 7/2009 Chase ..... B67D 1/001 141/1
2009/0205747 A1 * 8/2009 Lillard, Jr. ..... B67D 1/0888 141/94
2010/0102101 A1 4/2010 Keily
2010/0117836 A1 5/2010 Seyed Momen et al.
2011/0062179 A1 3/2011 Stollery et al.
2011/0108571 A1 * 5/2011 Hagleitner ..... A47K 5/1217 222/39
2011/0132931 A1 6/2011 Wright
2011/0208710 A1 * 8/2011 Lesavich ..... G06F 17/30864 707/706
2011/0264285 A1 * 10/2011 Mattos, Jr. ..... B67D 1/0888 700/283
2012/0111884 A1 5/2012 Choi
2012/0199602 A1 8/2012 Jordan et al.
2012/0278622 A1 11/2012 Lesavich et al.
2013/0238118 A1 * 9/2013 Haas ..... G07F 11/00 700/231
2014/0069951 A1 * 3/2014 Schmidt ..... A47K 5/1217 221/13
2014/0142748 A1 * 5/2014 Geigel ..... G07F 9/026 700/237
2014/0189792 A1 7/2014 Lesavich et al.
2015/0053709 A1 2/2015 Dennison et al.
2015/0053710 A1 2/2015 Dennison et al.
2015/0230645 A1 8/2015 Dennison et al.
2015/0265107 A1 * 9/2015 Buckalter ..... A47K 5/1211 222/63
2015/0374441 A1 12/2015 Machado et al.
2015/0379301 A1 12/2015 Lesavich et al.
2016/0196711 A1 * 7/2016 Castellani ..... G07F 9/026 700/237
2016/0216714 A1 * 7/2016 Wegelin ..... G05B 15/02
2016/0244311 A1 * 8/2016 Burks ..... B67D 1/0888
2016/0321654 A1 11/2016 Lesavich et al.

* cited by examiner

SANITARY TOUCH-FREE AUTOMATIC CONDIMENT DISPENSING APPARATUS AND METHOD OF USE

FIELD OF INVENTION

This application relates to automatic dispensing of condiments. More specifically, it relates to a sanitary touch-free automatic condiment dispensing apparatus and method of use.

BACKGROUND OF THE INVENTION

A "condiment" is something that is added to food to impart or enhance its flavor. Many condiments are available packaged in single-serving packets, such as ketchup, mustard, mayonnaise, food sauces (e.g., Bar-B-Q, hot sauces, dipping sauces, and soy sauce, etc.), salad dressings, etc. These food sauces are particularly supplied with take-out or fast-food meals. Condiments are usually applied by the diner.

At many fast-food restaurants, food courts and food trucks, condiments are dispensed with manual pumps from a reservoir containing the condiment. Such condiments are also dispensed with automatic pumps, in some cases the automatic pumps are activated with sensor or detectors such as infra-red detectors.

One problem with manual pumps is that the pump handle collects bacteria or viruses since multiple users touch the pump handle daily. Such bacteria leads to unsanitary conditions and cross contamination on the pump handle and may cause a user to contract a disease or lead to a disease outbreak (e.g., Flu, Cold, *E. Coli, Salmonella*, Hepatitis, etc.) Another problem with manual pumps is the amount of condiment dispensed is inconsistent and unregulated dependent on how hard or how many times a user pushes down the pump handle. A large force will dispense a large amount of the condiment. A small force will dispense a small amount of the condiment. Multiple pumps will result in an excessive amount of the condiment being dispensed. This leads to an unsanitary method for dispensing condiments that is waste full creating unnecessary costs for the business owner supplying the condiments.

One problem with the automatic pumps is that if a single sensor or detector is used, a person moving or standing near the pump may unintentionally activate the sensor and dispense the condiment. Another problem is that children often activate such automatic pumps over and over causing wasteful dispensing of the condiments and creating a mess.

There have some attempts to solve some of the problems associated with condiment dispensers. There are also some similar solutions for automatically dispensing hand soap.

For example, U.S. Pat. No. 8,700,809, that issued to Ferragut teaches 'A substance communicating device for use in conjunction with an appliance or a system including an appliance and a substance communicating device. The substance communicating device has a service connector component operably engageable with a service connector component of the appliance to permit the communication of a substance between the appliance and the substance communicating device. Information related to the substance can be communicated to the appliance and used to affect the physical cycle of operation of the appliance."

U.S. Pat. No. 8,650,736 that issued to Robertson, et al. teaches "A dispenser for viscous condiments including a tubular sidewall having opposite ends. One opposite end is open and can receive a plunger or piston therein for applying force to a condiment contained within the tubular sidewall. The other end of the sidewall includes a dispenser valve assembly including a member secured to an inturned flange portion of the sidewall with the flange portion being generally normal to the sidewall. The dispenser valve assembly is suitably secured to the flange portion as by heat sealing, such as a bead of hot melt, to form a composite laminated structure that is resistant to the penetration of liquid elements of the condiments. The dispenser valve assembly further includes a valve plate having one or more selectively openable discharge openings that will open and close under the influence of the pressure applied to the condiment in order to discharge the condiment."

U.S. Pat. No. 8,146,781, that issued to Robertson, et al. teaches "dispenser is provided for viscous condiments. The dispenser includes a tubular sidewall having opposite ends. One opposite end is open and can receive a plunger or piston therein for applying force to condiment contained within a compartment inside of the sidewall. The other end of the sidewall includes a dispenser valve assembly comprising a member secured to an inturned flange portion of the sidewall with the flange portion being generally normal to the sidewall. The dispenser valve assembly is suitably secured to the flange portion as by heat sealing to form a composite laminated structure that is resistant to the penetration of liquids from the condiments. A bead of hot melt can be provided to seal an exposed outer edge of the dispenser valve assembly and to seal the dispenser valve assembly to the sidewall. The dispenser valve assembly includes a valve plate having one or more selectively openable discharge openings formed therein that will open and close under the influence of pressure applied to the condiment within the dispenser."

U.S. Pat. No. 8,096,445, that issued to Yang, et al. teaches "An electric soap dispenser that includes sensors for detecting the presence of an object. The dispenser can be configured to dispense an amount of liquid soap, for example, upon detecting the presence of an object. The dispenser can include various features for enhancing the performance thereof. For example, the dispenser can include an additional button for manual operation of the pump. Additionally, the dispenser can detect the voltage of a power supply and compensate for a drop in voltage of the power supply so as to produce more uniform dispensations of the liquid product."

U.S. Pat. No. 7,258,247, that issued to Marquez teaches "An automated system for dispensing condiment packets includes a magazine for storing a stack of condiment packets and a dispenser for metering out those condiment packets. Multiple magazines and dispensers can be combined in a single condiment delivery assembly, thereby providing the means for dispensing a variety of condiment flavors. The delivery assembly can be incorporated into a fast food vending machine or can be designed as a standalone unit."

U.S. Pat. No. 6,894,270, that issued to Bailey teaches "A washroom device sensor uses at least one infrared beam that forms a longitudinal, rather than spot-shaped, sensing zone for detecting the presence of a user. The increased detection area of the longitudinal sensing zone ensures that at least a portion of the beam will contact a user using the washroom device. The beam may be adjustable in two or more directions to generate two or more sensing zones in different positions, allowing optimization of the sensing zone location with respect to a particular washroom device and the anticipated position of the device user."

U.S. Pat. No. 6,189,736, that issued to Phallen, et al. teaches "A condiment dispensing apparatus for dispensing condiments from a bag-in-box type container (108). There is a high durometer compressible elastomeric liquid flow tube (14), an infeed and outfeed thereto and therefrom, and a movable anvil (26) with a round surface to compress the tube. There is an opposed stationary anvil (28) which holds the tube for compression by the movable anvil. The tube is held between the anvils (26, 28) in a slightly compressed state even when the anvil is retracted. There is a control assembly (FIG. 15) that causes extension and retraction of the movable anvil to cause flow through the tube, and subsequent delivery of condiment to a dispensing fixture (110)."

U.S. Pat. No. 5,988,440, that issued to Saunders, et al. teaches, "Liquid soap dispenser for sensing the presence of a user's hands in the vicinity of a nozzle (6), and dispensing soap through the nozzle (6) in response to the detection of the user's hands. The dispenser includes a cylinder (10) and a plunger (21) within the cylinder (10), a magnetic core (12) coupled to the cylinder (10) or the plunger (21), and a solenoid (14) which is activated in response to the detection of a user's hands to cause relative movement of the plunger (21) within the cylinder (10) to dispense the soap. Preferably a plurality of dispensers are connected to a single reservoir of liquid soap."

U.S. Pat. No. 5,625,908 that issued to Shaw teaches "A wash station comprises a sink and a faucet. A source of water and a source of soap are provided. An electrically operated valve is interposed between the water source and the faucet for selectively supplying water thereto, and a pump and valve are interposed between the soap source and the faucet for selectively supplying soap thereto. An electrically operated roll towel dispenser is disposed proximate the sink. A first infrared sensor is operably associated with the sink for determining the presence of a user. A control mechanism is operatively associated with the valves, the pump, the roll towel dispenser and the sensor for causing water and soap to be selectively supplied to the faucet and for thereafter causing a length of roll towel to be dispensed."

U.S. Pat. No. 5,492,247, that issued to Shu, et al. teaches "An automatic soap dispenser having an infrared sensing device and associated circuitry to trigger a driver device into operation. The dynamic power of the device is generated from a motor, through a speed reducing gear to deliver a low speed, high torque driving power to a toothed piece. The toothed piece is driven forward in a direction perpendicular to the soap feeding tube of the soap storage bag, allowing liquid soap in the feeding tube to be squeezed and dispensed for hands cleaning. When the squeezing operation is accomplished, the resiliency of the feeding tube pushes the toothed piece back to its original position and is ready for the next soap dispensing."

U.S. Pat. No. 5,344,047, that issued to Chen teaches "An automatic liquid soap dispenser includes a liquid soap container which receives liquid soap therein and which has a bottom wall that is formed with an outlet port. A flow control unit includes a plunger and a tubular body secured to a bottom surface of the bottom wall such that a through-hole at a closed rear portion of the tubular body is aligned with the outlet port. The closed rear portion of the tubular body is further formed with an upright soap outlet adjacent to the through-hole. A ball valve unit controls the flow of liquid soap through the soap outlet. The plunger has a piston which extends fittingly and movably into the tubular body via an open front portion of the latter, and a flexible shaft portion connected to the piston. An actuating unit includes an infrared unit for detecting a target, a driving unit activated by the infrared unit upon detection of the target, and a driving gear driven rotatably by the driving unit. The shaft portion of the plunger is connected eccentrically to the driving gear so that rotation of the driving gear results in linear movement of the piston within the tubular body to dispense a predetermined amount of the liquid soap through the soap outlet. A contact switch is activated by the driving gear when the driving gear completes one revolution and deactivates the driving unit when activated."

U.S. Pat. No. 5,199,118, that issued to Cole teaches "A hand sanitizing wash station including a sink, a soap dispenser located above the sink for supplying soap, a water dispensing faucet located above the sink operated by a solenoid valve, a hot-air dryer located above the sink for supplying hot-air, a first infrared sensor for detecting the proximity of a user, the first sensor being operatively connected to the soap dispenser and the solenoid valve to activate the soap dispenser and the solenoid valve upon detecting the presence of a user, and a second infrared sensor for detecting the presence of a user, the second sensor being operatively connected to the solenoid valve and the hot-air dryer such that the second sensor will deactivate the solenoid valve and will activate the hot-air dryer."

However, these solutions still do not solve all of the problems associated with a sanitary and regulated method for dispensing condiments. Thus, it is desirable to solve some of the problems associated with condiment dispensers.

SUMMARY OF THE INVENTION

In accordance with preferred embodiments of the present invention, some of the problems associated with condiment dispensers are overcome. A sanitary, touch-free automatic condiment dispensing apparatus is presented.

The automatic sanitary touch-free condiment dispensing apparatus includes a two-stage detection process for detecting and automatically dispensing a pre-determined amount of a condiment (e.g., ketchup, mustard, food sauces, salad dressing, desert toppings, etc.) or another fluid (e.g., soap, etc.) without accidental or wasteful dispensing.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein.

DETAILED DESCRIPTION OF PREFERRED EMBODIMENTS

Exemplary Automatic Condiment Dispensing Apparatus

Figure 1:
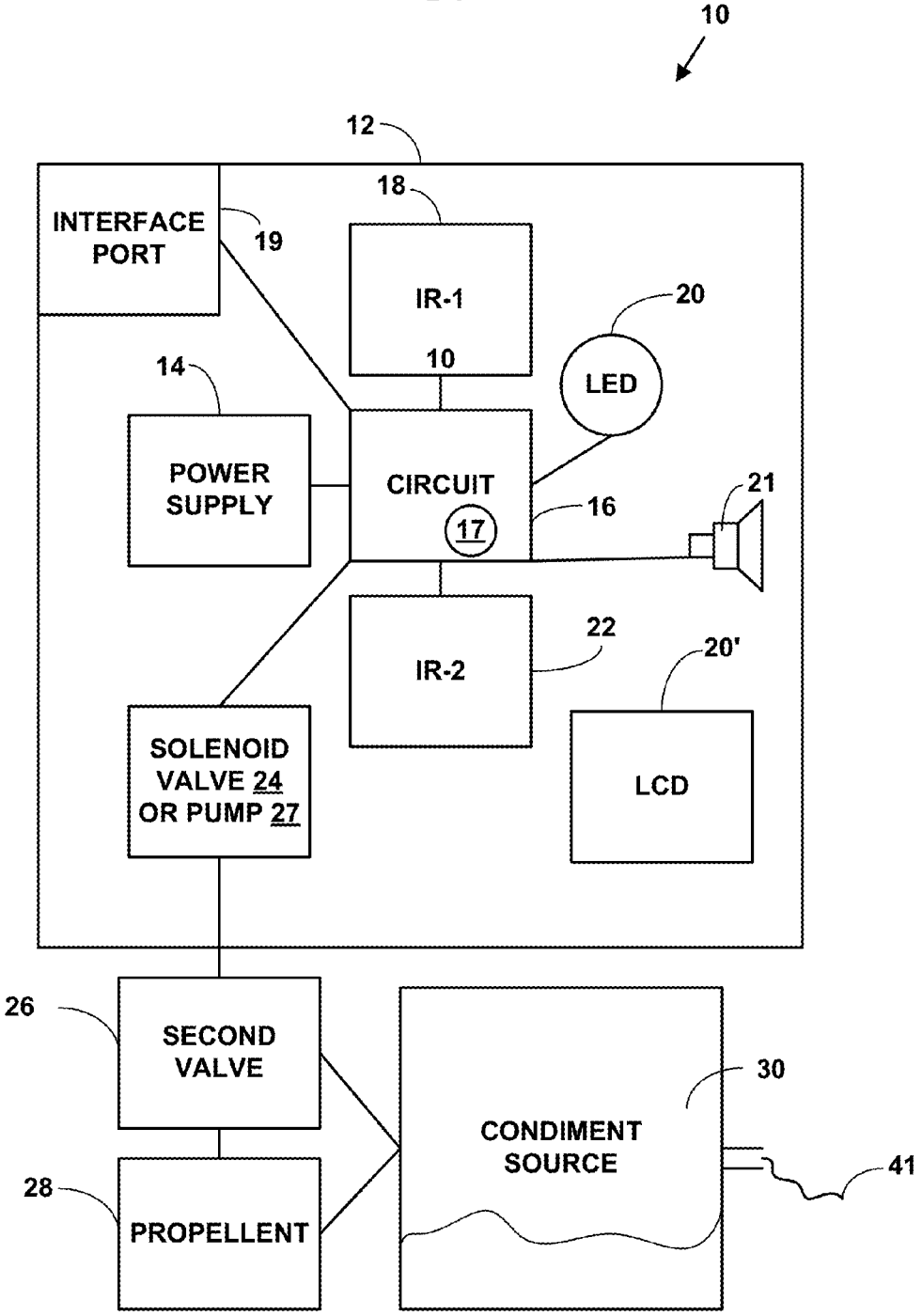
FIG. 1 is a block diagram illustrating a sanitary touch-free automatic condiment dispensing apparatus.

FIG. 1 is a block diagram 10 illustrating a touch-free sanitary automatic condiment dispensing apparatus 12. The touch-free sanitary automatic condiment dispensing apparatus 12 comprising a power supply 14; an electronic circuit 16 connected to the power supply 12 configured for automatically controlling and dispensing a pre-determined amount of a condiment; a first infrared (IR) sensor 18 connected to the electronic circuit 16 with a first detection field of first size with first detection orientation for detecting a first dispensing event for initiating the pre-determined amount of the condiment and for activating a second IR sensor 22; one or more light emitting diodes (LED) 20 connected to the electronic circuit 16 for visually indicating the first IR sensor 18 has detected the first dispensing event and for indicating the visually indicating the second IR sensor 22 has detected a second dispensing event; the second IR sensor 22 connected to the electronic circuit 16 with a second detection field of a second size of a second detection orientation for detecting the second dispensing event to dispense the pre-determined amount of condiment and for initiating automatic dispensing of the pre-determined amount of the condiment via a solenoid valve 24 or pump 27; and the solenoid valve 24 connected to the electronic circuit 16 and a second valve 26 and a propellant source 28 and/or a pump 27 and one or more condiment sources 30 for opening for automatically dispensing the pre-determined amount of the condiment 41 and closing after the pre-determined amount of the condiment has been automatically dispensed. However, the present invention is not limited to the components described and more, fewer or other components can be used to practice the invention.

For the present invention, a "condiment" is something that is added to food to impart or enhance its flavor. As used herein, a "condiment" includes food sauces (e.g., ketchup, mustard, mayonnaise, BBQ, sauces, fruit sauces, tomato sauces, etc.) desert sauces and toppings, (e.g., chocolate, strawberry, etc.) prepared sauces such as Hollandaise sauces, etc.), salad dressings, syrups, etc. The condiments may be dispensed by the apparatus 12 for any meal (e.g., breakfast, lunch, dinner), for dessert and/or for snacks, etc. The apparatus 12 may also be used to dispense various types of soups and/or broths. The present is not limited the definition of the condiment herein and can be used to dispense any type of edible substance applied to a food in a liquid, semi-liquid, gelatinous, viscous and/or other format that can be dispensed from apparatus 12

Figure 2A:
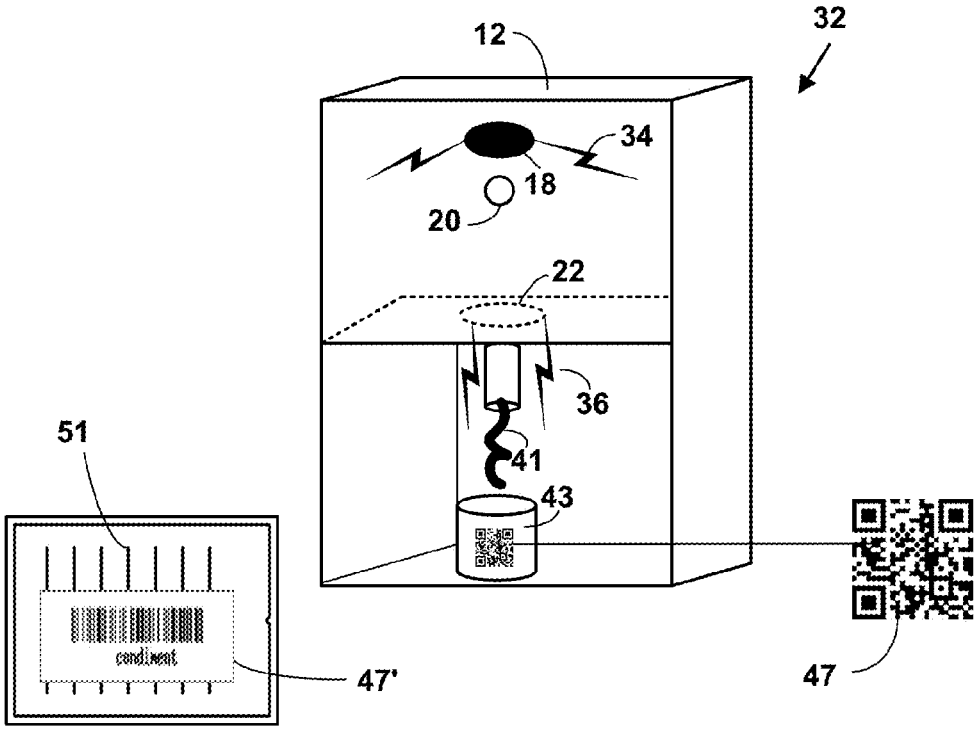
FIGS. 2A and 2B are block diagrams illustrating a front view of the touch-free sanitary automatic condiment dispensing apparatus of FIG. 1.
Figure 2B:
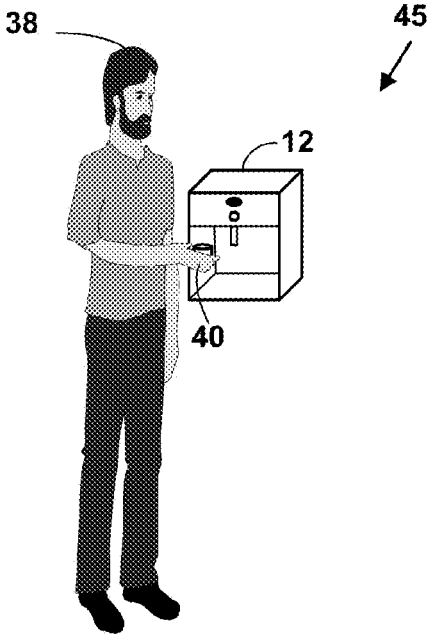

FIGS. 2A and 2B are block diagrams 32 and 45 illustrating a front view of the touch-free sanitary automatic condiment dispensing apparatus of FIG. 1. FIG. 2 is not drawn to scale for the purposes of simplicity to illustrate the features of the invention.

The automatic condiment dispensing apparatus 12 is described with an exemplary embodiment. However, the present invention is not limited to this exemplary embodiment and other embodiments can be used to practice the invention.

In such an exemplary embodiment the power supply 14 includes a Direct Current (DC) and/or an Alternating Current (AC) power supply 14 and/or a combination thereof.

The power supply 14 includes an electronic device that supplies electric power to an electrical load. The primary function of a power supply is to convert one form of electrical energy to another and, as a result, power supplies are sometimes referred to as electric power converters. Some power supplies are discrete, stand-alone devices, whereas others are built into larger devices along with their loads. Every power supply must obtain the energy it supplies to its load, as well as any energy it consumes while performing that task, from an energy source. All power supplies have a power input, which connects to the energy source, and a power output that connects to the load. In many power supplies the power input and output consist of electrical connectors.

In one embodiment, the power supply 14 includes a DC power supply. A DC power supply 14 is one that supplies a voltage of fixed polarity (either positive or negative) to its load. Depending on its design, a DC power supply may be powered from a DC source or from an AC source. DC power supplies, include, but are not limited to, batteries, thermocouples, solar cells, capacitors, etc.

A "battery" is a device consisting of one or more electrochemical cells that convert stored chemical energy into electrical energy.

A "thermocouple" is a temperature-measuring device consisting of two dissimilar conductors that contact each other at one or more spots. It produces a voltage when the temperature of one of the spots differs from the reference temperature at other parts of the circuit.

A "solar cell" (also called a photovoltaic cell) is an electrical device that converts the energy of light directly into electricity by the photovoltaic effect.

A "capacitor" (originally known as a condenser) is a passive two-terminal electrical component used to store energy electrostatically in an electric field. For example, the mechanical motion of the solenoid valve 24, other valves and/or pumps is used to dispense the condiment can be used re-charge the capacitor.

In another embodiment, the power supply 14 includes an AC power supply.

An AC power supply 12 typically takes the voltage from a main power source, (e.g., 110 volt wall socket, etc.) and lowers it to a desired voltage.

In another embodiment, the power supply 14 includes a switched-mode power supply (SMPS). In an SMPS, the AC mains input is directly rectified and then filtered to obtain a desired DC voltage. The resulting DC voltage is then switched on and off at a high frequency by electronic switching circuitry, thus producing an AC current that will pass through a high-frequency transformer or inductor, Switching occurs at a very high frequency (e.g., typically 10 kHz to 1 MHz), thereby enabling the use of transformers and filter capacitors that are much smaller, lighter, and less expensive than those found in linear power supplies operating at mains frequency. After the inductor or transformer secondary, the high frequency AC is rectified and filtered to produce the desired DC output voltage.

However, the present invention is not limited to the power supplies discussed and other types of power supplies and/or other combinations of AC and DC power can be used to practice the invention.

The electronic circuit 16 is connected to the power supply 14 and is configured for automatically dispensing a pre-determined amount of a condiment by controlling the other components of the apparatus 12.

In one embodiment, the electronic circuit 16 includes an integrated circuit (IC) or monolithic integrated circuit (also referred to as an IC, a chip, or a microchip). An integrated circuit is a set of electronic circuits on one small plate ("chip") of semiconductor material, normally silicon. However, the present invention is not limited to such an embodiment and other types of circuits can be used to practice the invention.

The electronic circuit 16 includes an operating environment for the present invention comprising a processing system with one or more high speed Central Processing Unit(s) ("CPU") or other types of processors, a non-transitory memory and an interface port 19. However, the present invention is not limited to this embodiment and can be practiced with and/or without and interface port 19.

In accordance with the practices of persons skilled in the art of computer programming, the present invention is described below with reference to acts and symbolic representations of operations or instructions that are performed by the processing system, unless indicated otherwise. Such acts and operations or instructions are referred to as being "computer-executed," "CPU executed" or "processor executed."

It will be appreciated that acts and symbolically represented operations or instructions include the manipulation of electrical signals by the CPU. An electrical system represents data bits which cause a resulting transformation or reduction of the electrical signals, and the maintenance of data bits at memory locations in a memory system to thereby reconfigure or otherwise alter the CPU's operation, as well as other processing of signals. The memory locations where data bits are maintained are physical locations that have particular electrical, magnetic, optical, or organic properties corresponding to the data bits.

The data bits may also be maintained on a non-transitory computer readable medium including magnetic disks, optical disks, organic memory, and any other volatile (e.g., Random Access Memory ("RAM")) or non-volatile (e.g., Read-Only Memory ("ROM")) mass storage system readable by the CPU.

Figure 3:
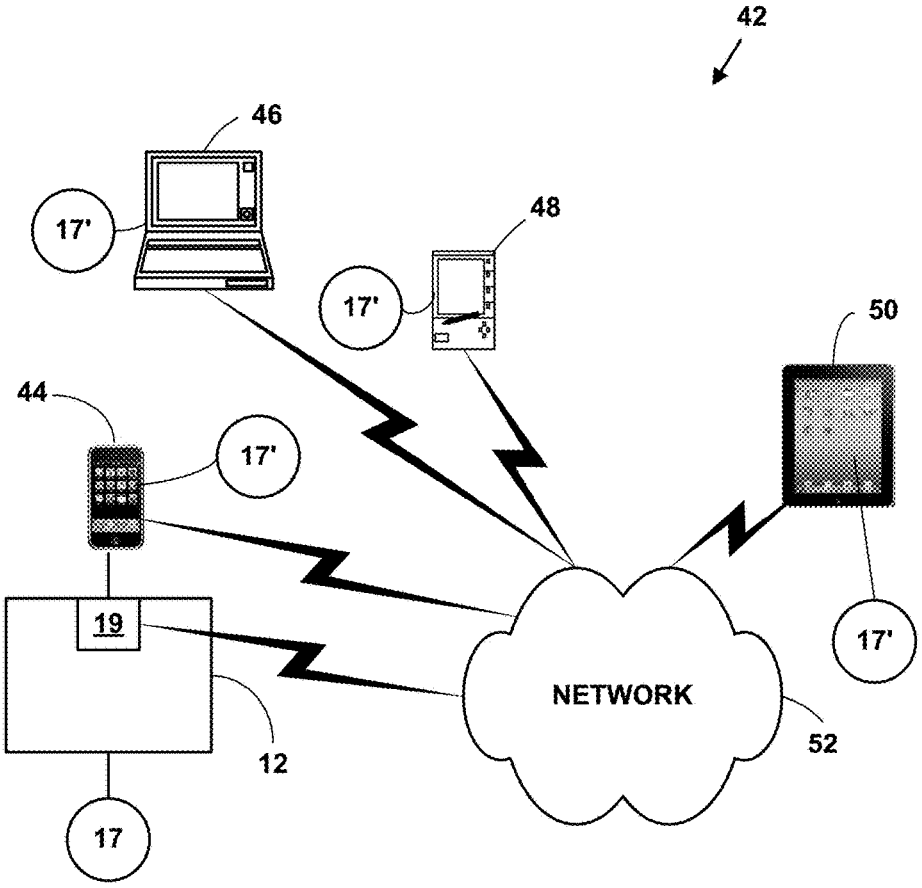
FIG. 3 is a block diagram illustrating another exemplary touch-free sanitary automatic condiment dispensing system.

FIG. 3 is a block diagram illustrating another exemplary touch-free sanitary automatic condiment dispensing system 42.

In one embodiment, data bits may comprises an application program 17 executed by the one or more CPUs and/or processors. The application program 17 is configurable to allow the pre-determined amount of condiment dispensed to be changed, the detection fields 34, 36 of the IR sensors 18, 22 to be changed, etc. The application program 17 may be communicating with via another network device with one or more processors with a configuration application 17' and including network devices such as a smart phone 44, computer 46, personal digital/data assistant 48, electronic tablet 50, etc. over a wired or wireless communications network 52 (e.g., Internet, intranet, wireless or wired telephone network, etc.). In such an embodiment, the apparatus 12 may be configured locally with the network device 44-50 and/or remotely via the communications network 52.

In one embodiment, the application program 17 also sends error messages (e.g., out of order, solenoid value 24 problem, pump 27 problem, etc.) and/or alerts (e.g., low battery, low propellant, etc.) in real-time to the network devices 44-50 when an error occurs with the apparatus 12 occurs, the apparatus is running low and/or has run out of a condiment 41, and/or has run out a propellant 28, etc. This allows a manager and/or other user of the apparatus to remotely monitor the apparatus 12 and determine when errors occur and/or when the apparatus 12 needs to be re-filled.

In one exemplary embodiment, the application program 17' on the network devices 44-50 are used to send and receive signals to/from the electronic circuit to dispense the condiments 41. In such an embodiment, the network device 44-50 via the application program 17' automatically dispense a pre-determined amount and pre-determined type of condiments 41 based on user preferences. For example, a desire may desire ketchup and mustard on their hamburger with two ounces of ketchup and one ounce mustard dispensed.

However, the present invention is not limited to such embodiments and the invention may be practiced with and/or without application program 17, 17' and with and/or without the functionality for dynamic configuration and/or use of a communications network 52.

In another embodiment, the pre-determined amount of condiment dispensed is not configurable and is determined during a process used to manufacture the apparatus 12.

Returning to FIG. 1, the first infrared (IR) sensor 18 is connected to the electronic circuit 16 for detecting a first dispensing event.

In one embodiment, the first dispensing event includes detecting a person 38 dispensing the pre-determined amount of the condiment 41. In such an embodiment, the first detecting event includes the person 38 activating the first IR sensor 18 with a first hand, standing in front of the apparatus 12, etc.

In another embodiment, the first dispensing event includes the person 38 placing the condiment cup 43 under a spout 70, 78 in the apparatus 12 with a first hand 40 triggering the first IR sensor 18 and using a second hand 40' to trigger the second IR sensor 22 to dispense the condiment 41 into the condiment cup 43. However, the present invention is not limited to such embodiments and other first dispensing events can be used to practice the invention.

In another embodiment, the first dispensing event includes the person 38 using their body heat by standing in front of the apparatus to trigger the first IR sensor 18 and using a hand 40 to trigger the second IR sensor 22 to dispense the condiment 41 into the condiment cup 43. However, the present invention is not limited to such embodiments and other first dispensing events can be used to practice the invention.

In another embodiment, the first dispensing event includes detecting a bar code 47 from a condiment container 43 and/or on a paper tray liner 51 including a bar code 47'. In such an embodiment, the apparatus 12, could not be accidently activated by a person walking by the apparatus 12, a child playing with the apparatus 12, etc. In such an embodiment, the bar code 47 activates the first IR sensor 18 and creates the first dispensing event. The person 38 activates the second IR sensor 22 and creates the second dispensing event.

For example, in FIG. 2B, an actual QR bar code 47 when decoded includes the text "ketchup" for dispensing ketchup and a linear bar code 47' on an exemplary paper tray liner 51 includes the text "condiment" for dispensing plural types of condiments. However, the present invention is not limited to such embodiments and/or bar codes and other bar codes can be used to practice the invention.

A "barcode"47 is an optical machine-readable representation of data, which shows data about the object to which it attaches. Originally, barcodes represented data by varying the widths and spacing of parallel lines, and may be referred to as linear or 1 dimensional (1D). Later they evolved into rectangles, dots, hexagons and other geometric patterns in 2 dimensions (2D). Although 2D systems use a variety of symbols, they are generally referred to as barcodes as well. Barcodes originally were scanned by special—optical scanners called barcode readers, scanners and interpretive software.

Table 1 illustrates exemplary linear barcodes, the standards of all of which are incorporated by reference. However, the present invention is not limited to the exemplary linear barcodes listed in Table 1, and more fewer and other linear barcodes can also be used to practice the invention.

TABLE 1

| Linear Bar Codes |
|---|
| U.P.C. |
| Codabar |
| Code 25-Non-interleaved 2 of 5 |
| Code 25-Interleaved 2 of 5 |
| Code 39 |
| Code 93 |
| Code 128 |
| Code 128A |
| Code 128B |
| Code 128C |
| Code 11 |
| CPC Binary |
| DUN 14 |
| EAN 2 |
| EAN 5 |
| EAN 8, EAN 13 |
| Facing Identification Mark |
| GS1-128 (formerly known as UCC/EAN-128), incorrectly referenced as EAN 128 and UCC 128 |
| GS1 DataBar, formerly Reduced Space Symbology (RSS) |
| HIBC (HIBCC Health Industry Bar Code) |
| ITF-14 |
| Latent image barcode |
| Pharmacode |
| Plessey |
| PLANET |
| POSTNET |
| Intelligent Mail barcode |
| MSI |
| PostBar |
| RM4SCC/KIX |
| JAN |
| Telepen |

Table 2 illustrates exemplary matrix (2D) barcodes, the standards of all of which are incorporated by reference. However, the present invention is not limited to the exemplary matrix barcodes listed in Table 2, and more fewer and other matrix barcodes can also be used to practice the invention.

TABLE 2

| Matrix Bar Codes |
|---|
| 3-DI |
| ArrayTag |
| Aztec Code |
| Small Aztec Code |
| Chromatic Alphabet |
| Codablock |
| Code 1 |
| Code 16K |
| Code 49 |

TABLE 2-continued

| Matrix Bar Codes |
|---|
| ColorCode |
| Compact Matrix Code |
| CP Code |
| CyberCode |
| d-touch |
| DataGlyphs |
| Datamatrix |
| Datastrip Code |
| Dot Code A |
| EZcode |
| Grid Matrix Code |
| High Capacity Color Barcode |
| HueCode |
| INTACTA.CODE |

TABLE 2-continued

| Matrix Bar Codes |
|---|
| InterCode |
| JAGTAG |
| Lorem ipsum |
| MaxiCode |
| mCode |
| MiniCode |
| MicroPDF417 |
| MMCC |
| Nintendo e-Reader#Dot code |
| Optar |
| PaperDisk |
| PDF417 |
| PDMark |
| QR Code |
| QuickMark Code |
| SmartCode |
| Snowflake Code |

TABLE 2-continued

| Matrix Bar Codes |
|---|
| ShotCode |
| SPARQCode |
| SuperCod |
| Trillcode |
| UltraCode |
| UnisCode |
| VeriCode, VSCode |
| WaterCode |

In one specific embodiment, the application 17 interacts with a bar code reader application. However, the present invention is not limited to a bar code reader application and other applications can also be used to practice the invention.

In one specific exemplary embodiment, a QR bar code is used. However, the present invention is not limited to QR codes and other types of bar codes can also be used to practice the invention.

In one specific exemplary embodiment, all of the bar codes 47 are the same. In another embodiment, the bar codes 47 are not all the same.

In one specific exemplary embodiment, the bar code 47 includes encoded instructions as to which condiment to dispense. For example, a first condiment container 43 includes a first bar code 47 to dispense ketchup, a second condiment container 43' includes a second bar code 47 to dispense mustard, etc. However, the present invention is not limited to such and embodiment and other embodiments can be used to practice the invention.

In one specific embodiment, the bar code 47 is included on a paper tray liner 51. The paper tray liner 51 is placed over a plastic, metal, etc. tray that is used to carry food items. The first IR sensor 18 reads the bar code 47 from the paper tray liner and dispenses the desired condiment 41 from the apparatus 12. However, the present invention is not limited to such and embodiment and other embodiments can be used to practice the invention.

In one exemplary embodiment, the first IR sensor 18 includes, but is not limited to, an NFT-7345 infrared charged couple device (CCD) scanner, sold by Opticon, Inc. This IR sensor is a fixed-position scanner using infrared light to scan barcodes 47 at scan rates of 200 scans per second. The first IR sensor 18 described is exemplary only and the present invention is not limited to the IR sensor mentioned and other IR sensors, sold by other companies can be used to practice the invention.

In another embodiment, the first dispensing event includes detecting a person 38 dispensing the pre-determined amount of the condiment 41 and for activating a second IR sensor 22.

However, the present invention is not limited to these first detecting events and other first detecting events can be used to practice the invention.

"Infrared (IR)" is electromagnetic radiation with longer wavelengths than those of visible light, extending from the nominal red edge of the visible spectrum at 700 nanometers (nm) to 1 mm. This range of wavelengths corresponds to a frequency range of approximately 430 THz down to 300 GHz. Most of the thermal radiation emitted by objects, including humans, near room temperature is infrared.

In one embodiment, the first IR sensor 18 includes a passive infrared sensor (PIR sensor) is an electronic sensor that measures infrared (IR) light radiating from objects in its field of view. All objects with a temperature above absolute zero emit heat energy in the form of radiation. Usually this radiation is invisible to the human eye because it radiates at infrared wavelengths, but it can be detected by electronic devices designed for such a purpose. However, the present invention is not limited to passive IR sensors and other types of IR sensors and other types of sensors can be used to practice the invention.

The term "passive" in this instance refers to the fact that PIR devices do not generate or radiate any energy for detection purposes. They work entirely by detecting the energy given off by other objects. It is important to note that PIR sensors don't detect or measure "heat" per se; instead they detect the Infrared radiation emitted from an object which is different from but often associated/correlated with the object's temperature In one embodiment, the PIR sensor 18 is a solid state sensor or set of sensors, made from pyroelectric materials—materials which generate energy when exposed to heat. Typically, the sensors are approximately ¼ inch square (40 $mm^2$), and take the form of a thin film. Materials commonly used in KR sensors include gallium nitride (GaN), caesium nitrate ($CsNO_3$), polyvinyl fluorides, derivatives of phenylpyridine, and cobalt phthalocyanine. The sensor is often manufactured as part of an integrated circuit.

In one embodiment, the first IR sensor 18 includes a first detection field 34 of a first size of a first "forward" facing orientation on the apparatus 12 to detect a person 38 standing in front of apparatus 12 desiring to dispense the condiment. In such an embodiment, the first detection field 34 is of size of about four to five inches (about ten to twelve centimeters) and includes the first detection field 34 that has been determined experimentally to optimally detect a person 38 standing directly in front of the apparatus 12. Detection fields of other sizes (i.e., are too big, etc.) and other orientations (e.g., not forward, etc.) may falsely detect a person 38 walking by the apparatus or may not detect a person 38 at all (i.e., are too small, etc.). However, the present invention is not limited to such an embodiment, and other detection field sizes, and other detection orientations can be used to practice the invention.

In another embodiment, the first IR sensor 18 includes an active sensor. However, the present invention is not limited to such an embodiment, and other types of IR sensors and/or other types of sensors can be used to practice the invention Active IR sensors rely on transmissions and feedback to detect changes in the area of coverage. By sending out a constant stream of stimuli, these sensors then measure and compare changes from prior readings. Because of this perpetual back and forth activity, active sensors consume a significantly larger amount of energy compared to passive alternatives. The three most common formats in the active sensor designation include microwave, ultrasonic, and tomographic. However, the present invention is not limited to such embodiments and other types of Active IR sensors can be used to practice the invention.

With a "microwave" based active sensor, microwave pulses are sent out. From here, reflections that bounce off moving objects are noted and compared to previous entries that the sensor has observed. That works much the same way as a police radar gun and can be effective at tracking and exposing outdoor movement.

"Ultrasonic" active sensors focus on sending out high frequency sound waves that are inaudible to the human ear. When the sound waves make contact with people, animals, or other objects that move, a reading is created. Much like a microwave sensor, these return signals are monitored and stored for a later comparison. Outside noise may set off a false alarm if it falls into a frequency or range that is close to the original emission.

"Tomographic" sensors monitor radio waves through mesh networks, which gives this option a high accuracy rating. From multiple locations, radio waves are emitted and bounced back to any sensors in range. Considering the ability to confirm the location of a moving object from several points, this option helps eliminate the hassle of false positives and unsubstantiated readings. It can also help differentiate between the motion of a small animal vs. that of a much larger human.

The light emitting diode (LED) 20 connected to the first IR sensor 18 is a visual indicator that the first IR sensor 18 has detected the dispensing event desiring to dispense the condiment 41 and the second IR sensor 22 has detected the second dispensing event.

In one embodiment, the light emitting diode (LED) 20 is also used to indicate the apparatus 12 is in an operational state ready to dispense condiments 41.

A light-emitting diode (LED) is a two-lead semiconductor light source. It resembles a basic pn-junction diode, which emits light when activated. LEDs are used as indicator lamps for electronic devices, replacing small incandescent bulbs. LEDs have many advantages over incandescent light sources including lower energy consumption, longer lifetime, improved physical robustness, smaller size, and faster switching. The LED 20 includes various colors including, but not limited to red, green, blue, yellow, etc.

However, the present invention is not limited to LEDs and other types of bulbs and/or visual and/or sound indicators can be used to practice the invention.

In another embodiment, the LED 20 is replaced with a Liquid Crystal Display (LCD) screen 20' and/or other type of display screen. In such an embodiment, the LCD display screen 20' instructs the user through the dispensing process and provides dispensing information. The LCD screen 20' is also used to display status and error messages such as "out-of-order," "please refill," etc. However, the present invention is not limited to such an embodiment and the present invention can be practiced with or without and LCD display screen 20'.

In another embodiment, the apparatus 12 further includes both the one or more LEDs 20 and the LCD display screen 20'.

In one embodiment, the LED 20 is a dual color LED and/or includes plural LEDs with different colors, that displays a first color, (e.g., red, etc.), when the apparatus 12 is not activated for dispensing but in an operation state and a second color (e.g., green, blue, etc.) when the apparatus 12 has been activated by the first IR sensor 18. However, the present invention is not limited to such an embodiment and more, fewer and/or other types of LEDs can be used to practice the invention.

In one embodiment, the LED 20 is replaced and/or the apparatus 12 further includes a speaker 21 connected to the electrical circuit 16. The speaker 21 is used as and audio indicator that the first IR sensor 18 has detected the person 38 desiring to dispense the condiment. Such an embodiment can be used to allow the apparatus 12 to be used also used by visually impaired people.

In one embodiment, the LED 20 indicates both a standby mode, one sensor engaged mode, and/or a both sensors engaged mode.

In another embodiment, the apparatus 12 includes a first lower LED 20 indicator related to a lower IR sensor 18, 20 and a second upper LED 20' related to the upper IR sensor 18, 20.

The second IR sensor 22 is connected to the electronic circuit 16 for initiating automatic dispensing of the pre-determined amount of the condiment 41. The second IR sensor 22 can be a passive, active, color detecting or bar code 47, 47', 51 reading as described above for the first IR sensor 18, and/or other type of IR sensor and/or other type of sensor.

In one embodiment, the second IR sensor 22 connected to the electronic circuit includes a second detection field 36 of a second size and a second detecting orientation for detecting the second dispensing event.

In one embodiment, the second IR sensor 22 connected to the electronic circuit 16 includes a second detection field 36 of a second size and a second detection orientation for detecting a portion 40 of the person 38 desiring to dispense the pre-determined amount of the condiment and/or detecting a bar code and/or detecting the condiment container 43 of a pre-determined color, size or shape used to store a dispensed condiment and/or a bar code 47 on the condiment container 43 and/or on a paper tray liner 51, and initiating automatic dispensing of the pre-determined amount of the condiment 41 via the solenoid valve 24.

In one embodiment, the second IR sensor 22 includes only an IR sensor 22 for detecting the portion 40 of the person 38. In another embodiment, the second IR sensor includes only an IR sensor 22 for detecting the condiment container 43 of the pre-determined color, size or shape. In another embodiment, the second IR sensor includes only an IR sensor 22 for detecting a bar code. In another embodiment, the IR sensor 22 includes an IR sensor 22 for detecting both the portion 40 of the person 38 and the condiment container 43. In another embodiment, the IR sensor 22 includes an IR sensor 22 for detecting both the portion 40 of the person 38 and the bar code 47. In such an embodiment the IR sensor 22 may include plural different IR sensors 22. However, the present invention is not limited to such an embodiment, and more, fewer and other types of combinations may be used to practice the invention.

In one embodiment, the second IR sensor 22 includes a second detection field 36 of a second size and a second detection orientation including a second "downward" facing detection orientation on the apparatus 12 to detect a portion (e.g., hand, fingers, etc.) 40 of the person 38 desiring to dispense the condiment 41. In such an embodiment, the second field 36 is of a second size of about three to four inches and the second detection field 36 has been determined experimentally to optimally detect the portion 40 of the person 38 holding a condiment container 43 under a portion of the apparatus 12. Detection fields of other sizes (i.e., are too big, etc.) and other detection orientations (e.g., not facing downward, etc.) may falsely detect the portion 40 of the person 38 attempting to place a container 43 for the condiment 41 in the apparatus 12 or the apparatus 12 or may not detect the portion 40 of the person 38 at all (i.e., are too small, etc.). However, the present invention is not limited to such an embodiment, and other detection field sizes, and other detection orientations can be used to practice the invention.

In one embodiment, the second IR sensor 22 includes a second detection field 36 of a second size and a second orientation 36 including a second "downward" facing detection orientation on the apparatus 12 to detect a condiment container 43 of a pre-determined color, size and/or shape used to store the dispensed condiment 41. In such an embodiment, the second field 36 is of a second size of about two to three inches (about five to seven centimeters) and the second detection field 36 has been determined experimentally to optimally detect the condiment container 43 under a portion of the apparatus 12. Detection fields of other sizes (i.e., are too big, etc.) and other detection orientations (e.g., not facing downward, etc.) may falsely detect the container 43 for the condiment 41 in the apparatus 12 or the apparatus 12 or may not detect the container 43 at all (i.e., are too small, etc.). However, the present invention is not limited to such an embodiment, and other detection field sizes, and other detection orientations can be used to practice the invention.

In one specific exemplary embodiment, the second IR sensor 22 detects a condiment container 43, that is white and/or transparent gray in color, circular in shape and holds approximately two ounces (about 60 milliliters) However, the present invention is not limited to such an embodiment, and other detection field sizes, and other detection orientations can be used to practice the invention.

In such an exemplary, for example, second IR sensor 22 includes, but is not limited to, a second IR sensor 22 such as specific IR sensor number TCS34725 sold by ADAFRUIT, or other similar IR sensors or companies, which has Red-Green-Blue (RGB) and Clear light sensing elements. This sensor includes an IR blocking filter integrated on-chip localized to the color sensing photodiodes that minimizes the IR spectral component of incoming light and allows different color measurements (e.g., for white, transparent, other color containers 43, etc.) to be made accurately. The second IR sensor 22 described is exemplary only and the present invention is not limited to the IR sensor mentioned and other IR sensors can be used to practice the invention.

In another embodiment, for example, the second IR sensor 22 includes, but is not limited to, a second IR sensor 22 such as specific IR sensor number GP2D15 and/or GP2D120 sold by ACRANAME or other similar IR sensors or companies to detect a condiment container 43 of a specific, size and/or shape. These IR sensors use triangulation and a small linear charged couple device (CCD) array to compute a distance and/or presence of objects in a field 34, 36 of view such as the condiment container 43. In order to triangulate, a pulse of IR light is emitted by an emitter. The light travels out into the field of view and either hits an object or just keeps on going. In the case of no object, the light is never reflected, and the reading shows no object. If the light reflects off an object, it returns to the detector and creates a triangle between the point of reflection, the emitter and the detector. The incident angle of the reflected light varies based on the distance to the object. The receiver portion of the IR rangers is a precision lens that transmits reflected light onto various portions of the enclosed linear CCD array based on the incident angle of the reflected light. The CCD array can then determine the incident angle, and thus calculate the distance to the object. This method of ranging is very immune to interference from ambient light and offers indifference to the color of the object being detected. The second IR sensor 22 described is exemplary only and the present invention is not limited to the IR sensor mentioned and other IR sensors can be used to practice the invention.

In another embodiment, the first IR sensor also includes, but is not limited to, specific IR sensor number TCS34725 sold by ADAFRUIT, or other similar IR sensors or companies, which has Red-Green-Blue (RGB) and Clear light sensing elements to detect a condiment container of a specific color. Such a first IR sensor 18 described is exemplary only and the present invention is not limited to the IR sensor mentioned and other IR sensors, sold by other companies can be used to practice the invention.

In another embodiment, the first IR sensor 18 also includes, but is not limited to, specific IR sensor number GP2D15 and/or GP2D120 sold by ACRANAME or other similar IR sensors or companies to detect a condiment container 43 of a specific, size and/or shape. Such a first IR sensor 18 described is exemplary only and the present invention is not limited to the IR sensor mentioned and other IR sensors, sold by other companies can be used to practice the invention.

In another embodiment, the second IR sensor 22 includes, but is not limited to, an NFT-7345 infrared charged couple device (CCD) scanner, sold by Opticon, Inc. This IR sensor is a fixed-position scanner using infrared light to scan barcodes 47. Such a second IR sensor 22 described is exemplary only and the present invention is not limited to the IR sensor mentioned and other IR sensors, sold by other companies can be used to practice the invention.

In another embodiment, the first IR sensor 18 detects a condiment container 43 and the second IR sensor 22 detects a condiment container 43 of a specific size, shape and/or color.

In another embodiment, the first IR sensor 18 detects a condiment container 43 and the second IR sensor detects a bar code 47 on the condiment container 43 and/or on a paper tray liner 51.

In another embodiment, the first IR sensor 18 detects a person 38 or a portion of a person 40 and the second IR sensor 22 detects a condiment container 43, a condiment container 43 of a specific size, shape and/or color and/or a detects a bar code 47 on the condiment container 43 and/or on a paper tray liner 51.

Various combinations of first IR sensors 18 and second IR sensors 22 and detection events can be used to practice the invention. The present invention is not limited to the specific IR sensors and/or detection events described and/or the various combinations described and other combinations of IR sensors and detection events can be used to practice the invention.

In another embodiment, the first detection event is captured by the first IR sensor 18 with an upward facing detection orientation and the second detection event is captured by the second IR sensor 22 with a downward detection orientation. In another embodiment, the first IR sensor 18 and the second IR sensor include a side-ways facing detection orientation (e.g., FIG. 7). In another embodiment, the apparatus 12 includes plural first IR sensors 18 and plural second IR sensors 22. In another embodiment, the apparatus 12 includes plural first IR sensors 18 and one second IR sensor 22 (e.g., FIG. 6, etc.) In another embodiment, the apparatus 12 includes plural second IR sensors 22 and one first IR sensor 18 (e.g., FIG. 6). However, the present invention is not limited to these dispensing events, orientations or combinations of first and second IR sensors 18, 22 described. Other various combinations can be used to practice the invention.

The solenoid valve 24 is connected to the electronic circuit 16 for opening for automatically dispensing the pre-determined amount (e.g., one ounce, etc.) of the condiment and closing after the pre-determined amount of the condiment has been automatically dispensed. However, the present invention is not limited to this embodiment and other types of solenoid values and/or other types of values can be used to practice the invention.

A "solenoid valve" 24 is an electromechanically operated valve. The valve is controlled by an electric current through a solenoid from the electronic circuit 16 in the case of a two-port valve the flow is switched on or off; in the case of a three-port valve, the outflow is switched between the two outlet ports. Multiple solenoid valves can be placed together on a manifold.

Solenoid valves 24 are the most frequently used control elements in fluidics. Their tasks are to shut off, release, dose, distribute or mix fluids. They are found in many application areas. Solenoids offer fast and safe switching, high reliability, long service life, good medium compatibility of the materials used, low control power and compact design. For example, the solenoid valve 24 can be used to dispense a mixture of ketchup and mustard, etc. Besides the plunger-type actuator which is used most frequently, pivoted-armature actuators and rocker actuators are also used Solenoid valves 24 are usually referred to simply as "solenoids," They are commonly used to control a larger valve used to control a propellant (usually compressed air or carbon dioxide ($CO_2$)).

In the present invention, the solenoid valve 24 is connected to a second valve 26, a propellant source 28 and one or more condiment sources 30 such as a single condiment and/or plural containers for plural condiments to be dispensed.

In another embodiment, the solenoid valve 24 is connected to a pump 27 and one or more condiment sources 30. A "pump" 27 is a mechanical or electro-mechanical device that moves fluids (e.g., liquids, etc.), or sometimes slurries, by mechanical action. In such an embodiment, the solenoid valve 24 would activate and deactivate the pump to dispense the condiment.

In another embodiment, the solenoid valve 24 is replaced by pump 27 and the apparatus does not include the solenoid valve 24 at all. However, the present invention is not limited to this embodiment and other embodiments can be used to practice the invention. In such an embodiment, the pump 27 is connected to the one or more condiment sources 30.

The electronic circuit 16 controls a timing of solenoid value 24 which in turn controls a timing of the second valve 26 which controls the propellant 28 and/or controls a pump 27, either of which dispenses the pre-determined amount 41 of the condiment 41. An amount of time the solenoid valve 24 and/or second valve is open and/or closed determines the pre-determined amount 41 of the condiment 41 dispensed.

A duration of the "open/close" of the solenoid valve 24 and/or pump 27 is adjustable as part of configuration settings for the apparatus directly or via application 17.

In one embodiment, the open/close cycle is controlled with a pre-determined timing so the solenoid value 24 includes a pre-determined delay (e.g., 1, second, 2 seconds, etc.) so the apparatus 12 is not intentionally or accidentally re-activated.

In an alternative embodiment, the apparatus 12 can be used to dispense soap, shampoo, conditioner, lotion, perfume, cologne, other fluids used for personal use or other fluids including laboratory regents, etc. instead of condiments.

Automatic Condiment Dispensing Apparatus Method of Use

Figure 4:
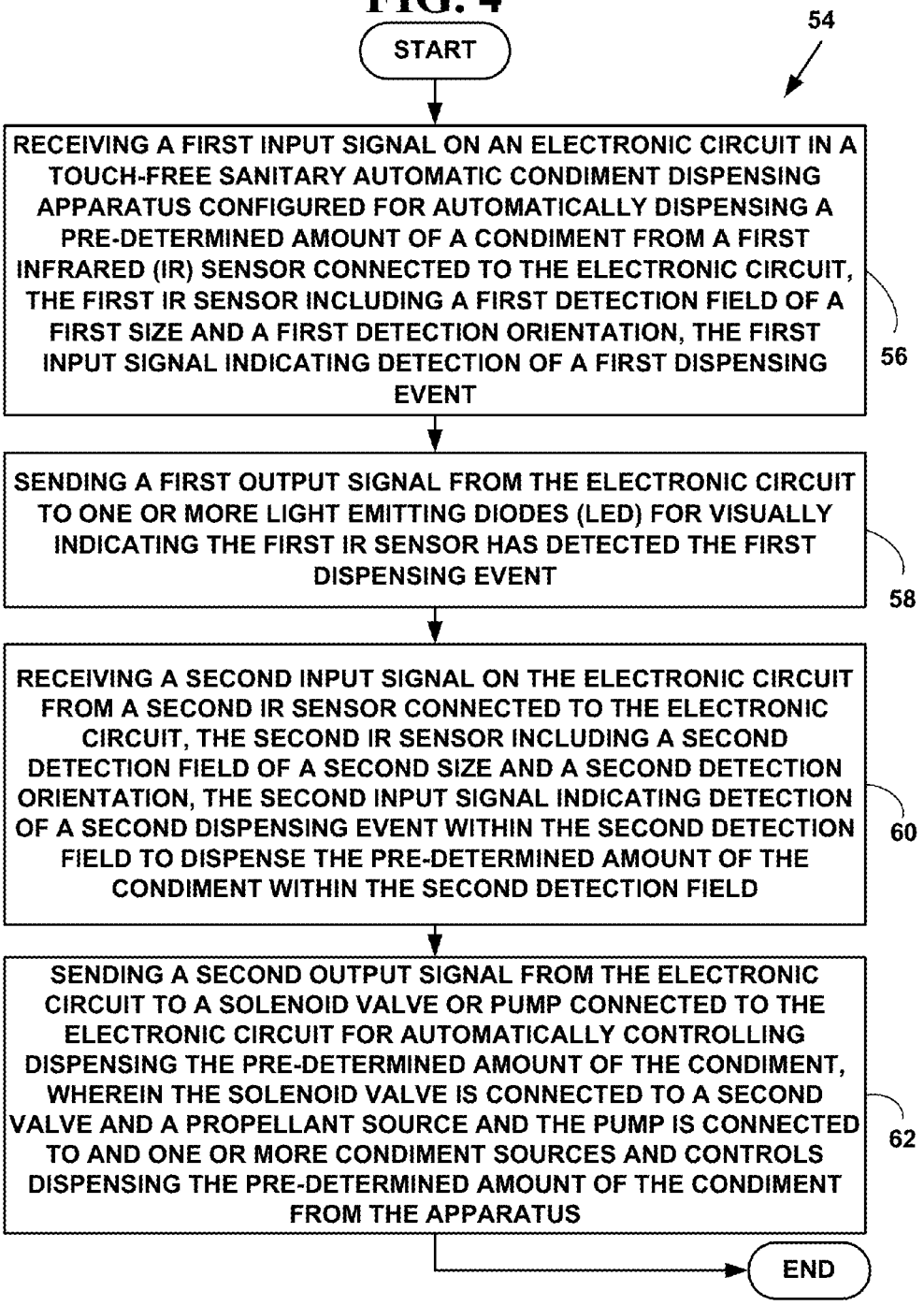
FIG. 4 is a flow diagram illustrating a method for touch-free sanitary automatic condiment dispensing.

FIG. 4 is a flow diagram illustrating a Method 54 for touch-free sanitary automatic condiment dispensing. At Step 56, a first input signal is received on an electronic circuit in an automatic condiment dispensing apparatus configured for automatically dispensing a pre-determined amount of a condiment, from a first infrared (IR) sensor connected to the electronic circuit, the first IR sensor including a first detection field of a first size and a first detection orientation, the first input signal indicating detection of a first dispensing event desiring to dispense the pre-determined amount of the condiment. At Step 58, a first output signal is sent from the electronic circuit to one or more light emitting diodes (LED) for visually indicating the first IR sensor has detected a first dispensing event desiring to dispense the pre-determined amount of the condiment. At Step 60, a second input signal is received on the electronic circuit from a second infrared (IR) sensor connected to the electronic circuit, the second IR sensor including a second detection field of a second size and a second detection orientation, the second input signal indicating detection of a second dispensing event within the second detection field desiring to dispense the pre-determined amount of the condiment. At Step 62, a second output signal is sent from the electronic circuit to a solenoid valve and/or a pump connected to the electronic circuit for automatically controlling dispensing the pre-determined amount of the condiment. The solenoid valve and/or pump is connected to a second valve, a propellant source and one or more condiment sources and controls dispensing the pre-determined amount of the condiment from the automatic condiment dispensing apparatus.

Method 54 is illustrative with an exemplary embodiment. However, the present invention is not limited to this exemplary embodiment and other embodiments can be used to practice the invention.

In such an exemplary embodiment at Step 56, a first input signal is received on an electronic circuit 16 in an automatic condiment dispensing apparatus 12 configured for automatically dispensing a pre-determined amount of a condiment 41, from a first infrared (IR) sensor 18 connected to the electronic circuit 16. The first IR sensor 18 including a first detection field 34 of a first size and a first detection orientation. The first input signal indicating detection of a person 38 and/or bar code 47 and paper tray liner 51 with a bar code 47' desiring to dispense the pre-determined amount 41 of the condiment 41.

In one exemplary embodiment, the first detection orientation is a forward facing orientation (e.g., FIGS. 2A, 2B, 5, 6). However, the present invention is not limited to such an embodiment, and the first detection orientation includes downwards, sideways and/or other types of detection orientations.

At Step 58, a first output signal is sent from the electronic circuit 16 to one or more light emitting diodes (LED) 20 for visually indicating the first IR sensor 18 has detected the first dispensing event to dispense the pre-determined amount 41 of the condiment 41.

At Step 60, a second input signal is received on the electronic circuit 16 from a second infrared (IR) sensor 22 connected to the electronic circuit 16. The second IR sensor 22 including a second detection field 36 of a second size and a second dispensing orientation.

The second input signal indicating detection of a portion 40 of the person 38 desiring to dispense the pre-determined amount 41 of the condiment 41 and/or the condiment container 43 of a pre-determined color (e.g., white, transparent, etc.), size (two ounces, etc.) and/or shape (e.g., circular, etc.) and/or bar code 47, 51, 47' within the second detection field 36.

In one exemplary embodiment, the second detection orientation is a downward facing orientation (e.g., FIGS. 2A, 2B, 5, 6, 7). However, the present invention is not limited to such an embodiment, and the first detection orientation includes downwards, sideways and/or other types of detection orientations.

At Step 62, a second output signal is sent from the electronic circuit 16 to a solenoid valve 22 and/or pump 27 connected to the electronic circuit 16 for automatically controlling dispensing the pre-determined amount 41 of the condiment 41. The solenoid valve 24 is connected to a second valve 26, a propellant source 28 and/or a pump 27 and one or more condiment sources 30 and controls dispensing the pre-determined amount 41 of the condiment 41 from the automatic condiment dispensing apparatus 12.

Figure 5:
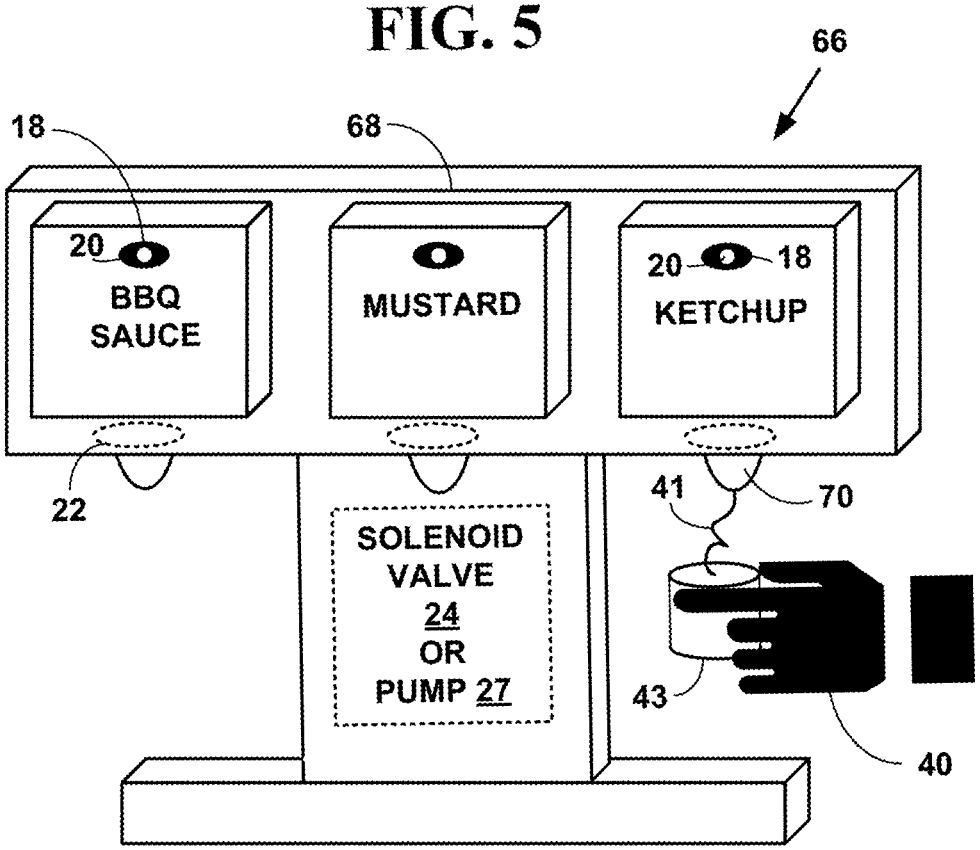
FIG. 5 is a block diagram illustrating another view of an exemplary touch-free sanitary automatic condiment dispensing apparatus.

FIG. 5 is a block diagram 66 illustrating another 68 exemplary embodiment of an automatic condiment dispensing apparatus 12. FIG. 5 illustrates plural first IR sensor 18 with LEDs 20 integral to the first IR sensor 18. However, the present invention is not limited to such an embodiment and other embodiments can be used to practice the invention. Plural different kind of condiments 41 are dispensed through plural spots 72. This embodiment illustrates plural first IR sensors 18 and plural second IR sensors 22. FIG. 5 illustrates three separate condiment/sauce dispensers. However, the present invention is not limited to such an embodiment, and more, fewer or other types of dispensers can configurations of the apparatus 12 can be used to practice the invention.

Figure 6:
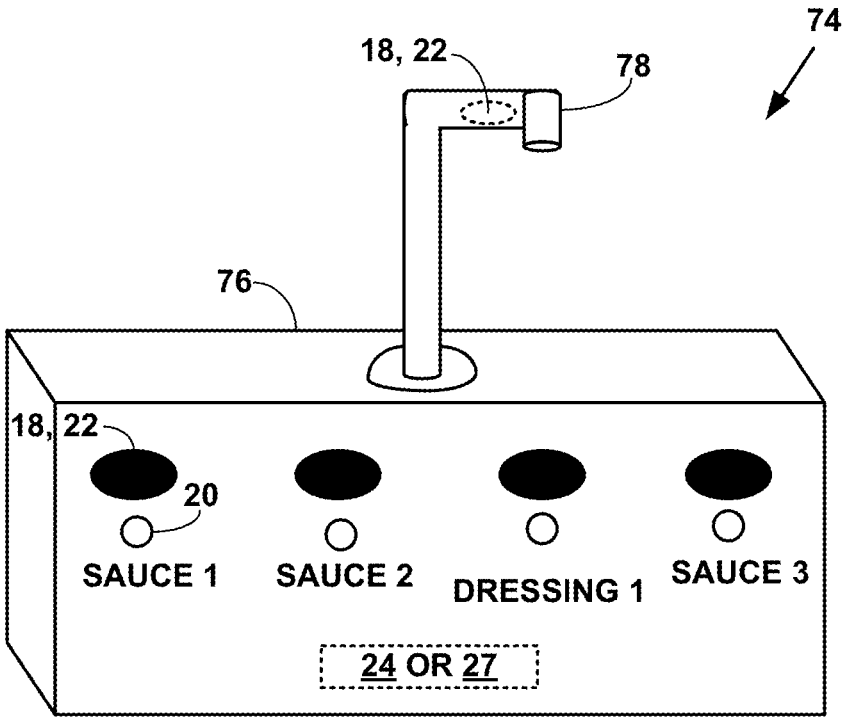
FIG. 6 is a block diagram illustrating another view of another exemplary touch-free sanitary automatic condiment dispensing apparatus.

FIG. 6 is a block diagram 74 illustrating another exemplary embodiment 76 of a touch-free sanitary automatic condiment dispensing apparatus 12. FIG. 6 illustrates plural first IR sensors 18 with separate LEDs 20. FIG. 6 also illustrates a single condiment/sauce dispensing spout 78 with a single second IR sensor 22. In this embodiment, when a first sauce is selected (e.g., Sauce 1, etc.) via the first IR sensor 18, the first LED 20 is activated. When the person 38 puts the condiment container 43 under the second IR sensor 22, the condiment 41 is automatically dispensed into the condiment container 43. However, the present invention is not limited to such an embodiment, and more, fewer or other types of configurations of the apparatus 12 can be used to practice the invention.

Figure 7:
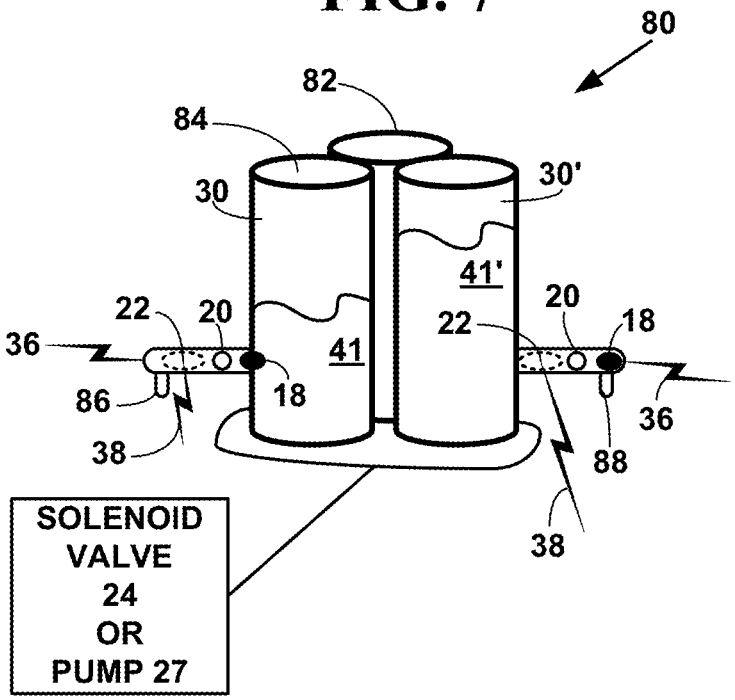
FIG. 7 is a block diagram illustrating another view of an exemplary touch-free sanitary automatic condiment dispensing apparatus.

FIG. 7 is a block diagram 80 illustrating another exemplary embodiment 82 of a touch-free sanitary automatic condiment dispensing apparatus 12. FIG. 7 illustrates plural condiment/sauce containers 30 that are cylindrical in shape. The plural containers are filled via top openings 84 in the containers 30. FIG. 7 illustrates a first spout 86 that includes LED 20 and second IR sensor 22. First IR sensor 18 is included on the cylindrical condiment/sauce container 30. First IR sensor 18 may be integral to the container 30 and/or placed on an outside surface of the container 30. FIG. 7 also illustrates a different second spout 88 that includes integral first IR sensor 18, LED 20 and second IR sensor 22. Plural different spouts 86, 88 may be used on apparatus 12 to dispense more popular and/or less popular condiments (e.g., ketchup vs. extreme BBQ sauce, etc.).

In one exemplary embodiment 82 in FIG. 7 the embodiment 82 includes a table-top "lazy-susan" and/or turntable, a rechargeable battery 14 and a pump 27 used to dispense the condiments 41, 41'. In such an embodiment, the apparatus 82 is placed on a battery 14 charger each evening to recharge. However, the present invention is not limited to such an embodiment an other embodiments can be used to practice the invention.

Another variety of FIG. 7 includes apparatus 12 with only first spouts 86 and/or includes apparatus with only second spouts 88. However, the present invention is not limited to such an embodiment, and more, fewer or other types of configurations of the apparatus 12 can be used to practice the invention.

In FIGS. 5 and 6, solenoid value 24 is illustrated as being integral to various housings 68, 76 used for apparatus 12. However, the present invention is not limited to such embodiments and solenoid value 24 can also be external to the apparatus housing 68, 76. FIG. 7 illustrates a solenoid value 24 as a separate component external to apparatus housing 82.

The various combinations of components in FIGS. 2 and 5-7 are exemplary only and do not limit the invention in any way. More, fewer and other sizes, shapes, configurations and/or design layouts of apparatus 12 can be used to practice the invention.

Figure 8:
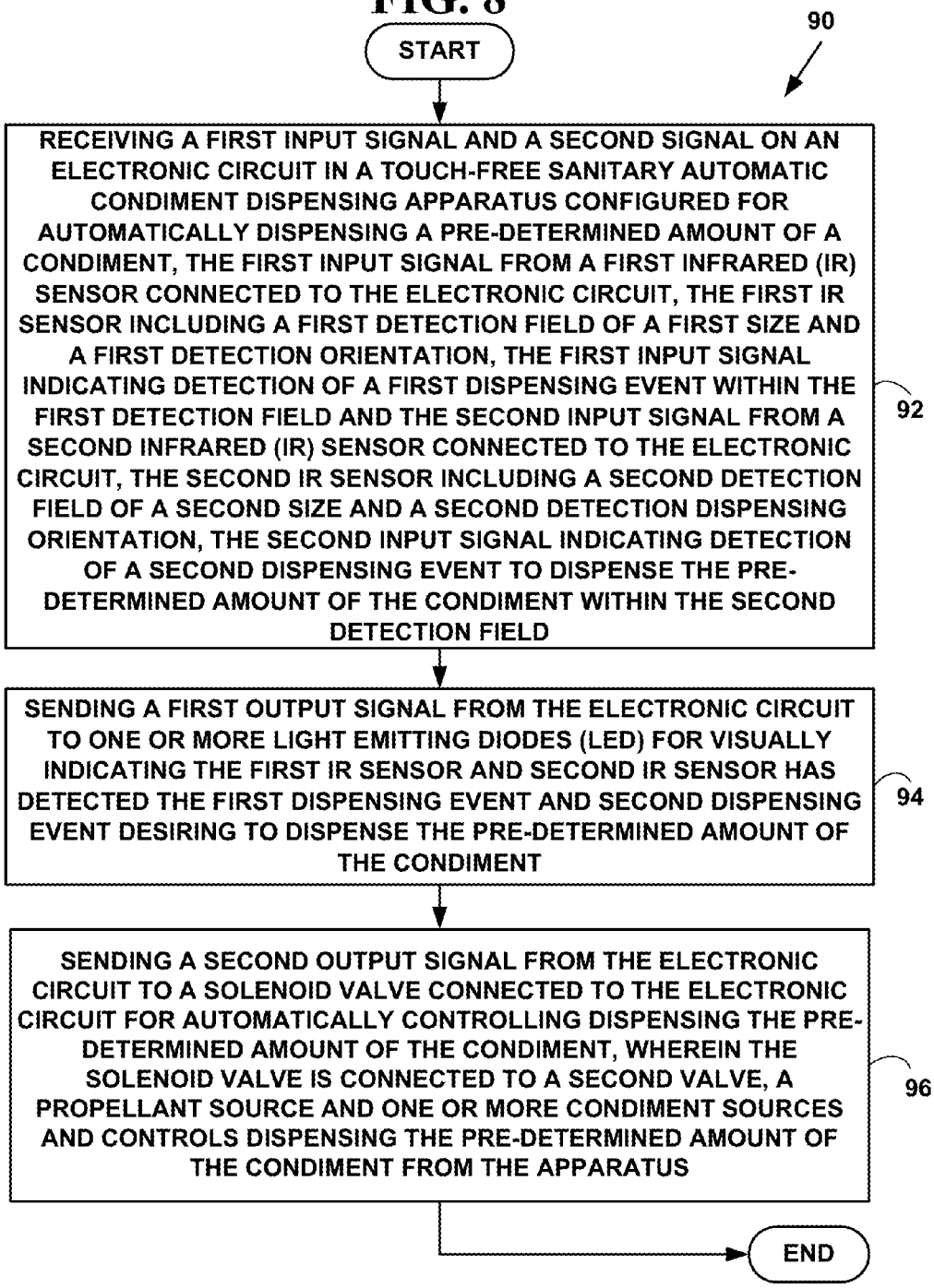
FIG. 8 is a flow diagram illustrating a method for touch-free sanitary automatic condiment dispensing.

FIG. 8 is a flow diagram illustrating a Method 90 for touch-free sanitary automatic condiment dispensing. At Step 92, a first input signal and a second signal are received on an electronic circuit in an automatic condiment dispensing apparatus configured for automatically dispensing a pre-determined amount of a condiment. The first input signal is from a first infrared (IR) sensor connected to the electronic circuit. The first IR sensor including a first detection field of a first size and a first detection orientation. The first input signal indicating detection of a first dispensing event within the first detection field The second input signal from a second infrared (IR) sensor connected to the electronic circuit. The second IR sensor including a second detection field of a second size and a second detection orientation. The second input signal indicating detection of second dispensing event to dispense the pre-determined amount of the condiment within the second detection field. At Step 94, a first output signal is sent from the electronic circuit to one or more light emitting diodes (LED) for visually indicating the first IR sensor and second IR sensor has detected the first dispensing event and the second dispensing event desiring to dispense the pre-determined amount of the condiment. At Step 96, a second output signal is sent from the electronic circuit to a solenoid valve and/or pump connected to the electronic circuit for automatically controlling dispensing the pre-determined amount of the condiment. The solenoid valve is connected to a second valve, a propellant source and one or more condiment sources and/or the pump is connected to one or more condiment sources and controls dispensing the pre-determined amount of the condiment from the automatic condiment dispensing apparatus into the condiment container.

Method 90 is illustrative with an exemplary embodiment. However, the present invention is not limited to this exemplary embodiment and other embodiments can be used to practice the invention.

In such an exemplary embodiment at Step 92 a first input signal and a second signal are received on an electronic circuit 16 in an automatic condiment dispensing apparatus 12 configured for automatically dispensing a pre-determined amount of a condiment 41. The first input signal is from a first infrared (IR) sensor 18 connected to the electronic circuit 16. The first IR sensor 18 including a first detection field 34 of a first size and a first detection orientation. The first input signal indicating detection of a first dispensing event within the first detection field 34. The second input signal is from a second infrared (IR) sensor 22 connected to the electronic circuit 16. The second IR sensor 22 including a second detection field 36 of a second size and a second detection orientation. The second input signal indicating detection of second dispensing event to dispense the pre-determined amount of the condiment 41 within the second detection field 36.

In one embodiment, the first input signal and the second input signal are received simultaneously on the electronic circuit 16. In such an embodiment, the electronic circuit is configured for receiving simultaneous signals. However, the present invention is not limited to such and embodiment and other embodiments can be used to practice the invention.

In another embodiment, the first and second input signals are not received simultaneously, but received within a pre-determined time period (e.g., 1 second, 2 seconds, 5 seconds, etc.) on the electronic circuit 16. In such embodiments, the electronic circuit 16 may latch in an electronic latch, the first input signal until the second input signal arrives.

An electronic "latch" is an example of a bistable multivibrator, that is, a device with exactly two stable states. These states are high-output and low-output. A latch has a feedback path, so information can be retained by the device. Therefore latches are memory devices, and can store one bit of data for as long as the device is powered. A latch is an example of a bistable multivibrator, that is, a device with exactly two stable states. These states are high-output and low-output. An electronic latch has a feedback path, so information can be retained by the device. Therefore latches can be memory devices, and can store one bit of data for as long as the device is powered. However, the present invention is not limited to such an embodiment and other embodiments can be used to practice the invention.

At Step 94, a first output signal is sent from the electronic circuit 16 to one or more light emitting diodes (LED) 20 for visually indicating the first IR sensor 18 has detected the first dispensing event and the second IR sensor 22 has detected the second dispensing event desiring to dispense 41 the pre-determined amount of the condiment 41.

At Step 96, a second output signal is sent from the electronic circuit 16 to a solenoid valve 24 connected to the electronic circuit 16 for automatically controlling dispensing the pre-determined amount of the condiment 41. The solenoid valve 24 is connected to a second valve 26, a propellant source 28 and one or more condiment sources 30 and controls dispensing the pre-determined amount of the condiment 41 from the automatic condiment dispensing apparatus 12 into the condiment container 43.

The apparatus 12 described herein is also used for dispensing condiments for fast food items and/or dispensing food sauces for breakfast (e.g., syrups, etc.), deserts (e.g., for ice cream, cakes, etc.), for main courses (e.g., tomato sauces, Hollandaise sauces, etc.) for other food items for fast food and non-fast food items.

A sanitary, touch-free automatic condiment dispensing apparatus and method of use is described herein. The sanitary touch-free automatic condiment dispensing apparatus includes a two-stage detection process (e.g., a person and a portion of person, a person and a condiment cup, a person and a bar code, etc.) for detecting and automatically dispensing a pre-determined amount of a condiment (e.g., ketchup, mustard, etc.) or another fluid (e.g., soap, shampoo, conditioner, lotions, etc.). without accidental or wasteful dispensing.

It should be understood that the architecture, programs, processes, methods and systems described herein are not related or limited to any particular type of computer or network system (hardware or software), unless indicated otherwise. Various types of general purpose or specialized computer systems may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more or fewer elements may be used in the block diagrams.

While various elements of the preferred embodiments have been described as being implemented in software, in other embodiments hardware or firmware implementations may alternatively be used, and vice-versa.

The claims should not be read as limited to the described order or elements unless stated to that effect. In addition, use of the term "means" in any claim is intended to invoke 35 U.S.C. §112, paragraph 6, and any claim without the word "means" is not so intended. Therefore, all embodiments that come within the scope and spirit of the following claims and equivalents thereto are claimed as the invention.

I claim:

1. A touch-free sanitary automatic condiment dispensing apparatus, comprising in combination:

a power supply;

an electronic circuit including one or more processors, a non-transitory memory and an application program executing in the non-transitory memory connected to the power supply configured for automatically dispensing one or more pre-determined amounts of one or more different types of condiments, wherein the application program on the electronic circuit controls with one or more signals: (1) a first infrared (IR) sensor detecting a first touch-free dispensing event, (2) a second infrared (IR) sensor detecting a second touch-free dispensing event, (3) one or more light emitting diodes (LED) visually indicating one or more operational modes, (4) a first timing of a solenoid valve which in turn controls a second timing of a second valve which in turn controls a propellant source which dispenses the one or more pre-determined amounts of the one or more different types condiments from one or more condiment sources, wherein an amount of time the solenoid valve is open and closed determines the one or more pre-determined amounts of the one or more different types of condiments dispensed and wherein the application program on the electronic circuit prevents the touch-free automatic condiment dispensing apparatus from intentionally or accidentally re-activating dispensing again of any condiments until a pre-determine time delay expires;

the first infrared (IR) sensor connected to the application program on the electronic circuit detecting with a first detection field of a first size and a first detection orientation the first touch-free dispensing event including: (1) detecting an IR signal emanating from a person or a first portion of the person, or (2) detecting a first wireless signal from an external network device with one or more processors and (3) then activating dispensing of the one or more pre-determined amounts of the one or more different types of condiments by activating the second IR sensor and activating one or more light emitting diodes (LED) via one or more signals sent to the application program on the electronic circuit;

the one or more light emitting diodes (LED) connected to the application program on the electronic circuit visually indicating with one or more signals received from the application program on the electronic circuit the touch-free sanitary automatic condiment dispensing apparatus is in an operational mode, visually indicating the first IR sensor has detected the first touch-free dispensing event and visually indicating the second IR sensor has detected the second touch-free dispensing event;

the second IR sensor connected to the application program on the electronic circuit activated by the first touch-free dispensing event detected by the first IR sensor with signals from the application program on electronic circuit detecting with a second detection field of a second size and a second detection orientation the second touch-free dispensing event, the second touch-free dispensing event including: (1) detecting a condiment container of a pre-determined color, size and shape used to store the dispensed condiment, or (2) detecting a bar code on the condiment container or on a paper tray liner, the bar code including a first set of one or more pre-determined types of condiments to dispense and a first set of one or more pre-determined amounts for a first set of one or more pre-determined types of condiments to dispense, or (3) detecting a second wireless signal from the external network device including a second set of a pre-determined types of condiments and a second set of one or more pre-determined amounts of the condiments to dispense, and then (4) initiating automatic dispensing of: (a) the first set of the one or more pre-determined types and the first set of the pre-determined amounts of the condiments, or (b) the second set of the pre-determined types of condiments and the second set of one or more pre-determined amounts of the condiments to dispense into the condiment container via one or more signals sent to the application program on the electronic circuit activating the solenoid valve; and the solenoid valve connected to the application program on the electronic circuit, the second valve, the propellant source and the one or more condiment sources, the solenoid valve automatically controlling dispensing the first or second sets of the pre-determined amounts of the first or second sets of the one or more pre-determined types of condiments into the condiment container, wherein the solenoid valve controls the second valve which in turn controls the propellant source which dispenses the first or second sets of the pre-determined amounts of the first or second set of the one or more pre-determined types of condiments from the one or more condiment sources into the condiment container.

2. The touch-free sanitary automatic condiment dispensing apparatus of claim 1 wherein the power source includes an alternating current (AC) power source or a direct current (DC) power source and wherein the DC power includes batteries, thermocouples, solar cells, or capacitors.

3. The touch-free sanitary automatic condiment dispensing apparatus of claim 1 wherein the solenoid valve, the second valve and the propellant source is replaced with a pump controlled by the application program on the electronic circuit, wherein the pump dispenses the first or second sets of the pre-determined amounts of the first or second set of the one or more pre-determined types of condiments from the one or more condiment sources.

4. The touch-free sanitary automatic condiment dispensing apparatus of claim 1 wherein the electronic circuit includes an integrated circuit including one or more processors, a non-transitory computer readable medium and an interface port.

5. The touch-free sanitary automatic condiment dispensing apparatus of claim 1 further including the application program comprising a plurality of instructions in the non-transitory computer readable medium for causing the one or more processors in the electronic circuit to configure via an interface port connected to the application program on the electronic circuit, a first detection field size for the first infrared (IR) sensor, a second detection field size for the second IR sensor, dispensing of the first set or the second set of the pre-determined amounts of the first set or the second set of the one or more pre-determined types of condiments and the timing of the solenoid valve the second valve and the propellant source.

6. The touch-free sanitary automatic condiment dispensing apparatus of claim 5 wherein the application program is configurable via the interface port from a second network device with one or more processors and wherein the application program when configured by the second network device automatically monitors operations of the touch-free sanitary automatic condiment dispensing apparatus and sends one or more messages to the second network device when any operational errors occur or when the propellant source or the one or more condiment sources in the touch-free sanitary automatic condiment dispensing apparatus need to be refilled.

7. The touch-free sanitary automatic condiment dispensing apparatus of claim 1 wherein the network device includes a smart phone, electronic tablet, laptop computer or personal digital assistant.

8. The touch-free sanitary automatic condiment dispensing apparatus of claim 1 wherein the first infrared (IR) sensor and the second IR sensor include a passive infrared sensor, an active infrared sensor, a color detecting infrared sensor or a bar code reading infrared sensor.

9. The touch-free sanitary automatic condiment dispensing apparatus of claim 1, further comprising an audio speaker connected to the application program on the electronic circuit for indicating with an audio sound or tone the first IR sensor has detected the person.

10. The touch-free sanitary automatic condiment dispensing apparatus of claim 1 wherein the first detection field of the first size includes a four to six inch detection field size and the first detection orientation includes a forward, downward, upward or side-ways facing orientation.

11. The touch-free sanitary automatic condiment dispensing apparatus of claim 1 wherein the second detection field of the second size includes a two to three inch detection field size and the second detection orientation includes a downward, upward, forward or side-ways facing orientation.

12. The touch-free sanitary automatic condiment dispensing apparatus of claim 1 wherein the solenoid valve includes a plurality of solenoid valve ports controlled by the application program on the electronic circuit.

13. The touch-free sanitary automatic condiment dispensing apparatus of claim 1 wherein the solenoid valve automatically controls dispensing of one condiment or a dispensing of a mixture of a plurality of condiments.

14. The touch-free sanitary automatic condiment dispensing apparatus of claim 1 wherein the condiment includes, ketchup, mustard, mayonnaise, a food sauce, salad dressing or a selected combination thereof.

15. The touch-free sanitary automatic condiment dispensing apparatus of claim 1 wherein the propellant source includes compressed air or carbon dioxide ($CO_2$).

16. The touch-free sanitary automatic condiment dispensing apparatus of claim 1 wherein the condiment is replaced with soap, shampoo, conditioner, lotion or another fluid.

17. The touch-free sanitary automatic condiment dispensing apparatus of claim 1 further including a Liquid Crystal Display (LCD) display for displaying status, error and dispensing information to a user of the automatic condiment dispensing apparatus.

18. A method for sanitary touch-free automatic condiment dispensing, comprising:

receiving a first input signal on an application program on an electronic circuit in a touch-free sanitary automatic condiment dispensing apparatus configured for automatically dispensing one or more pre-determined types and amounts of, condiments, from (1) a first infrared (IR) sensor, or (2) a wireless interface port connected to the application program on the electronic circuit, the first IR sensor including a first detection field of a first size and a first detection orientation, the first input signal indicating detection of a first touch-free dispensing event including detecting; (a) a condiment container of a pre-determined color, size and shape used to store the dispensed condiment, or (b) a first wireless signal from an external network device with one or more processors external to the touch-free sanitary automatic condiment dispensing apparatus;

sending a first output signal from the application program on the electronic circuit to one or more light emitting diodes (LED) for visually indicating the first IR sensor or the wireless interface port has detected the first touch-free dispensing event to dispense one or more pre-determined types and amounts of the condiments;

receiving a second input signal on the application program on the electronic circuit from a second infrared (IR) sensor or on the wireless interface port connected to the application program on the electronic circuit, the second IR sensor including a second detection field of a second size and a second detection orientation, the second input signal indicating detection of a second touch-free dispensing event including detecting a bar code on the condiment container or on a paper tray liner within the second detection field, or the wireless interface detecting a second wireless signal from the network device on the wireless interface port with user preferences to dispense the pre-determined amount of the condiment; and sending a second output signal from the application program on the electronic circuit to a solenoid valve connected to the application program of the electronic circuit automatically controlling dispensing one or more pre-determined types and amounts of condiments, wherein the solenoid valve is connected to a second valve, a propellant source and one or more condiment sources and controls dispensing one or more pre-determined types and amounts of the condiments from the automatic condiment dispensing apparatus into the condiment container.

19. A method for sanitary touch-free automatic condiment dispensing, comprising:

receiving a first input signal and a second signal on an application program on an electronic circuit in a touch-free sanitary automatic condiment dispensing apparatus configured for automatically dispensing one or more pre-determined types and amounts of condiments, the first input signal from a first infrared (IR) sensor connected to the application program on the electronic circuit, the first IR sensor including a first detection field of a first size and a first detection orientation, the first input signal indicating detection of a first touch-free dispensing event including detecting a first bar code on a condiment container of a pre-determined color, size and shape or on a paper tray liner within the first detection field and the second input signal from a second infrared (IR) sensor connected to the application program on the electronic circuit, the second IR sensor including a second detection field of a second size and a second detection dispensing orientation, the second input signal indicating detection of a second touch-free dispensing event including detecting an IR signal emanating from a person or a portion of a person, or (2) the first input signal including a first wireless signal from a network device with one or more processors external to the touch-free sanitary automatic condiment dispensing apparatus, the first input signal indicating detection of the first touch-free dispensing event including detection of the network device and the second input signal including a second wireless signal from the network device, the second input signal indicating detection of the second touch-free dispensing event including receiving user preferences from the network device for dispensing of condiments, to dispense the one or more pre-determined types and amounts of condiments within the second detection field;

sending a first output signal from the application program on the electronic circuit to one or more light emitting diodes (LED) for visually indicating the first IR sensor and second IR sensor has detected the first touch-free dispensing event and second touch-free dispensing event to dispense the one or more pre-determined types and amounts of condiments;

sending a second output signal from the application program on the electronic circuit to a pump connected to the application program on the electronic circuit automatically controlling dispensing the pre-determined amount of the condiment, wherein the pump is connected to one or more condiment sources, the pump controlling dispensing the one or more pre-determined types and amounts of condiments of the condiment from the touch-free sanitary automatic condiment dispensing apparatus.

20. The method of claim 18 wherein the first detection field of the first size includes a four to six inch detection field size and the first detection orientation includes a forward, downward, upward or side-ways facing orientation and second detection field of the second size includes a two to three inch detection field size and the second detection orientation includes a downward, upward, forward or side-ways facing orientation.

21. The touch-free sanitary automatic condiment dispensing apparatus of claim 1 further comprising a plurality of solenoid valves placed together on a manifold, the plurality of solenoid values on the manifold including a plurality of solenoid valve ports, the plurality of solenoid values and the plurality of solenoid valves controlled by the application program on the electronic circuit.

* * * * *